US005085272A

United States Patent [19]

Venables, IV

[11] Patent Number: 5,085,272

[45] Date of Patent: Feb. 4, 1992

[54] SPINE FIN HEAT EXCHANGER AND METHOD AND APPARATUS FOR PRODUCING SAME

[75] Inventor: Herbert J. Venables, IV, Chagrin Falls, Ohio

[73] Assignee: The Venables Machine and Tool Company, Cleveland, Ohio

[21] Appl. No.: 653,243

[22] Filed: Feb. 11, 1991

[51] Int. Cl.[5] ..... F28F 1/36

[52] U.S. Cl. ..... 165/184; 165/181

[58] Field of Search ..... 165/184, 181

[56] References Cited

U.S. PATENT DOCUMENTS

| | | | |
|---|---|---|---|
| 3,134,166 | 5/1964 | Venables, III | 29/890.048 |
| 3,362,058 | 1/1968 | Morris et al. | 29/890.048 |
| 4,102,027 | 7/1978 | Greever et al. | 29/890.048 |
| 4,138,997 | 1/1979 | La Porte et al. | 126/449 |
| 4,143,710 | 3/1979 | La Porte et al. | 165/182 |

FOREIGN PATENT DOCUMENTS

| | | | |
|---|---|---|---|
| 1437671 | 11/1988 | U.S.S.R. | 165/184 |
| 19866 | of 1907 | United Kingdom | 165/184 |

*Primary Examiner*—Allen J. Flanigan

*Attorney, Agent, or Firm*—Pearne, Gordon, McCoy & Granger

[57] ABSTRACT

A spine fin heat exchanger tube is provided with a multiplicity of cantilever spine fins extending from an imperforate base wrapped around a tube in a helical manner. The spine fins include an inner portion extending substantially radially from the base and free end portions which extend laterally to provide increased heat exchange surface within a given envelope size. Also disclosed are a method and apparatus for producing such spine fin heat exchanger tubes.

14 Claims, 4 Drawing Sheets

SPINE FIN HEAT EXCHANGER AND METHOD AND APPARATUS FOR PRODUCING SAME

BACKGROUND OF THE INVENTION

This invention relates generally to heat exchangers, and more particularly to a novel and improved spine fin heat exchanger tube and to a method and apparatus for producing such tube.

Prior Art

It is known to form spine fin heat exchanger tubing by helically winding a tube with spin fins formed by laterally cutting an elongated strip of metal to produce a multiplicity of narrow spines extending from an uncut base portion. Examples of such tubes and the method and apparatus for producing such tubes are described and claimed in the following United States Letters Patent, all issued to Herbert J. Venables III, or to Herbert J. Venables III as joint inventor with Herbert J. Venables IV: U.S. Pat. Nos. 3,005,253; 3,134,166; 3,160,129; 3,688,375; 3,920,217; 3,985,054; 4,532,788; and 4,542,568. All of such patents are incorporated herein by reference in their entirety.

In some instances, the spines extended from only one side of the base and formed with such base and L-shaped cross section. In other instances, the spines extended from both sides of the base, providing a U-shaped profile. In each instance, the strip was cut from one or both edges toward the uncut base portion, so that the spines extended in cantilever fashion from the base. It is also known to form a closed-loop, spinelike, helically wound heat exchanger tube. In such instances, the strip is cut along a center portion, leaving both edges uncut. The cut sections are then bent in the general shape of a top hat or inverted V, and helically wrapped on the tube, with the uncut edges positioned against the tube surface. Such tubes provide closed-loop spines, which tend to hold condensate, making them undesirable for use in environments where condensate or frost tends to form. European Patent Application No. 0 214 784 illustrates closed loop spines.

SUMMARY OF THE INVENTION

There are a number of aspects to the present invention. In accordance with one aspect of this invention, a spine fin heat exchanger tube provides spines having a novel and improved configuration or shape. In one embodiment, the spines extend in cantilever fashion from a base along a first or radial portion substantially radially with respect to the tube, and provide free end portions angled with respect to the radial portion in a direction opposite from the base portion. In such one embodiment, the strip is helically wound on a tube with a helix angle, which results in spacing between wraps so that the free end portions do not interfere or form loops with the spines of the next adjacent wrap.

By forming the spines with an angulated free end, it is possible to provide greater amounts of heat exchange surface within a given tube envelope. Therefore, improved heat exchanger capacity is provided for a given size heat exchanger. Further, such heat exchanger spine fin configuration provides improved capacity where low air flow rates exist, such as in the evaporators of refrigerators.

In other embodiments, the spines are curved and/or angled to improve the heat exchange capacity for various environments.

Another aspect of this invention involves a novel and improved apparatus for producing spine fin heat exchanger tubes with shaped fins. In one illustrated embodiment, a wrapping or winding machine provides two work stations including one common roll at which the free ends of the spines are bent at right angles from the plane of the strip and the strip is then bent to a generally U-shaped cross section.

In other embodiments, the apparatus is structured so that curved or angulated spines are produced.

Another aspect of this invention involves a novel and improved method for producing spine fin heat exchanger tubes with shaped spines.

These and other aspects of this invention are illustrated in the accompanying drawings, and are more fully described in the following specification.

DETAILED DESCRIPTION OF THE DRAWINGS

Figure 1:
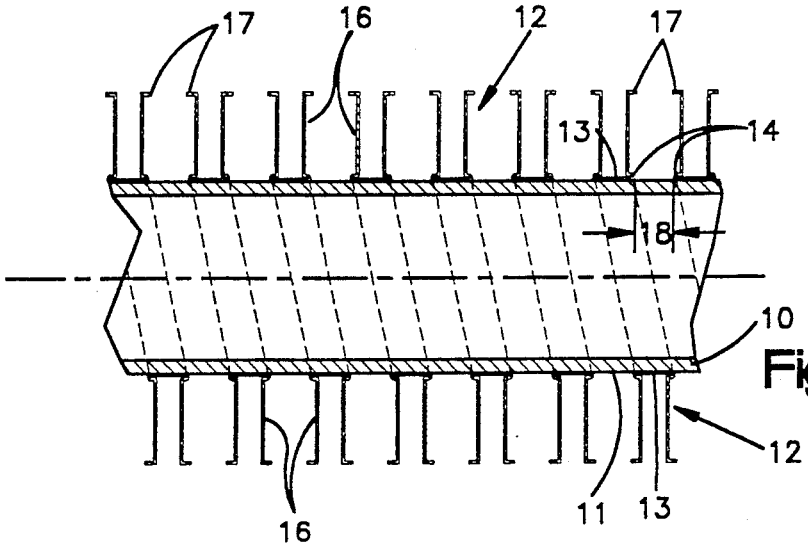
FIG. 1 is a fragmentary cross section of a first embodiment of a spine fin heat exchanger tube incorporating this invention, in which the free ends of the spines are bent at 90 degrees to extend laterally relative to the remainder of the spines.

FIG. 1 illustrates a portion of a heat exchanger tube incorporating the first embodiment of this invention. In such embodiment, a hollow tube 10 provides a cylindrical outer surface 11 on which a strip of spine fin material 12 is helically wrapped, as described in detail below.

The spine fin strip provides an imperforate base 13 formed with a hem 14 by a reverse bend. Extending generally radially with respect to the hem are a multiplicity of separate cantilever-like spines 16, the free ends of which are bent laterally at a right angle to provide laterally extending end portions 17.

In this illustrated embodiment, a single strip of spine fin material is helically wrapped around the tube at a helix angle, which produces a space 18 between adjacent edges of the hems of adjacent wraps which is at least substantially equal to the width of the hems, so that the laterally extending end portions 17 of each row of spines is spaced from the laterally extending end portions 17 of the adjacent spines of the adjacent wrap. Because of this spacing, the spines do not define closed loops, which would tend to collect moisture and reduce heat exchange efficiency in many applications. With this structure, the total envelope of the heat exchanger tube is smaller than would be produced in prior art spine fin heat exchanger tubes which extended radially to the ends of each spine. Consequently, a given envelope of a spine fin heat exchanger tube provides a greater amount of heat exchange surface. Also, in some installations, the laterally extending end portions tend to confine the air passing over the fins, resulting in greater contact with the spines and improved heat exchange efficiency. In many installations, this improves the overall capacity of the heat exchanger formed from such tubing.

Generally, heat exchangers are formed from heat exchanger tubing of the spine fin type by bending the wrapped tube to form a heat exchanger in which the tubes extend back and forth to provide multiple heat exchanger tube passes within the total heat exchanger. In other instances, the tube is bent in a curved or rectilinear manner so as to provide a heat exchanger which efficiently fits into the particular envelope of the apparatus in which it is installed. Further, the material normally used to form the tube and the spine fin strip is a metallic material having a high coefficient of thermal conduction such as aluminum.

Figure 2:
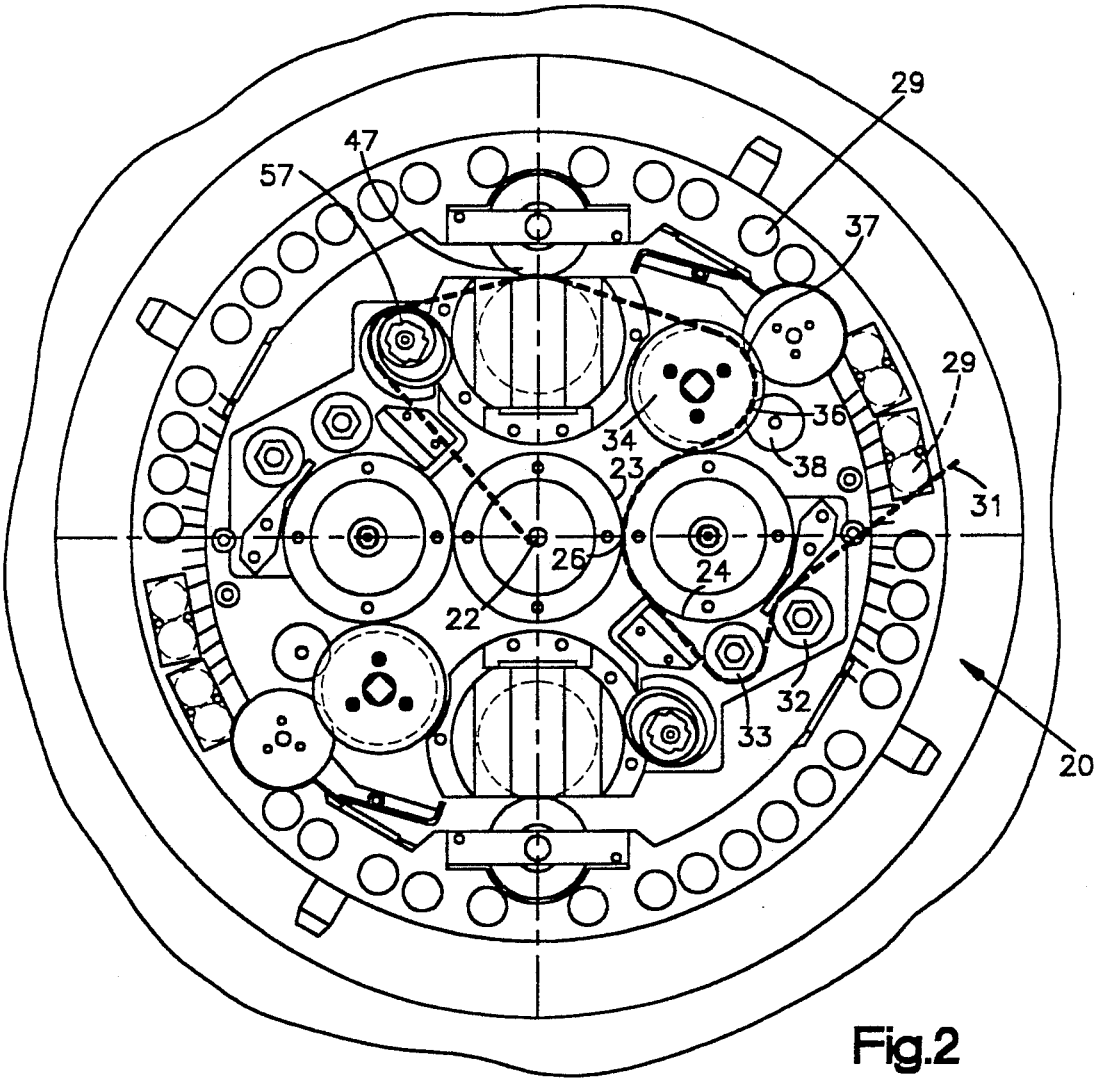
FIG. 2 is a plan view of a winding head apparatus for forming spine fin heat exchanger tubing in accordance with the present invention.

The heat exchanger tubing of FIG. 1 is preferably formed in a machine having a winding head, as illustrated in FIG. 2. This winding head is very similar to the winding head provided by the machine described in detail in U.S. Pat. No. 3,688,375, but differs therefrom by the addition of a single roller which produces laterally extending end portion 17. Therefore, U.S. Pat. No. 3,688,375 is incorporated herein in its entirety for a more detailed description of the entire machine.

The winding head 21 illustrated in FIG. 2 is journaled for rotation about a vertical axis 22, along which the hollow tube 11 extends and moves during the winding operation. The tube moves axially along the axis 22, but does not rotate during the winding operation. It is, however, within the broader aspects of this invention to use a machine in which the tube turns and the winding head does not.

The winding head 21 illustrated in FIG. 2 is provided with duplicate and symmetrically positioned components so that the winding head is completely dynamically balanced and can run at high speeds of rotation without encountering balancing problems. Such winding head is capable of simultaneously forming and winding two strips of material to form a double wrap. However, when it is supplied with a single strip of material to form a single strip of spine fin material, it produces a single wrap, as illustrated in FIG. 1. Even when the winding head is intended for single wrapping, it is desirable to supply dual wrap tooling, since dynamic balance is then achieved, and also in the event of wear of individual tooling components, they can be moved from one path to another and, in effect, constitute spare tooling parts.

Figure 2B:
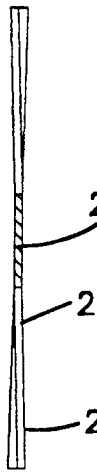
FIG. 2*b* is a fragmentary view taken generally along line 2*b*—2*b* of FIG. 2*a;*
Figure 2A:
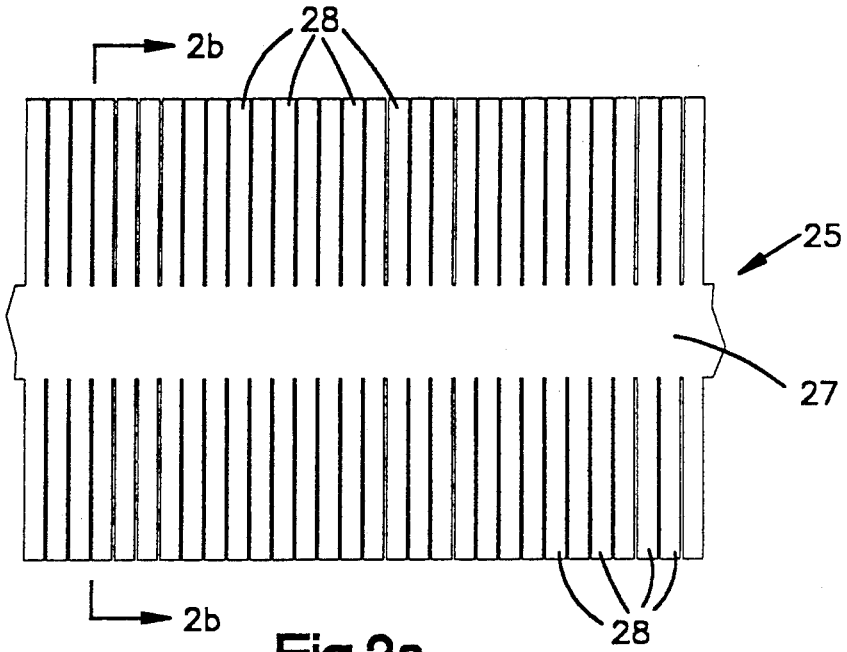
FIG. 2*a* is a fragmentary view of the strip of material used to form the spine fin after it is slit and before it is bent.

The material which is cut and shaped to produce the spine fins is positioned around the winding head in a coil and feeds into and through the winding head along a path indicated by the dotted line 31. The first operation is cutting. The winding head 20 is provided with a center cutter 23 which is journaled for rotation about the vertical axis 22 and cooperates with one of the other two cutters 24 to provide a cutting station 26 at which the strip of material 25 is cut inwardly from each edge toward the center, while leaving an imperforate, or uncut, center base 27, from which narrow spines 28 extend in cantilever fashion in opposite directions (as illustrated in FIGS. 2*a* and 2*b*). It is these spines 28 which are subsequently formed to produce the finished spine 16 of FIG. 1. During the cutting operation, there is a tendency for the spines 28 to twist relative to the base 27 a slight amount. The amount of twist can be adjusted by adjusting the cutters.

Positioned around the periphery of the winding head 20 are rollers 29 which guide the strip of material from the coil around the winding head and guide the strip into the path indicated by the dotted line 31 along which the strip moves during the forming and wrapping operations.

Initially, the strip passes around rollers 32 and 33, and from the roller 33 is guided into the cutting station 26. From the cutting station 26, the strip passes around a forming roll 34 which constitutes part of two forming stations 36 and 37. At the first forming station 36, illustrated in FIG. 3, the forming roll 34 cooperates with a roll former 38 to laterally bend the free ends of the spines 28 and produce the lateral end portion 17 of the finished spine.

Figure 3A:
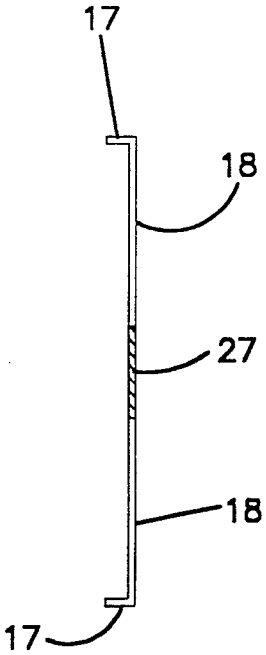
FIG. 3*a* is a cross section of the strip after the free ends of the spines are bent and before the strip is formed to a U-shape.
Figure 3:
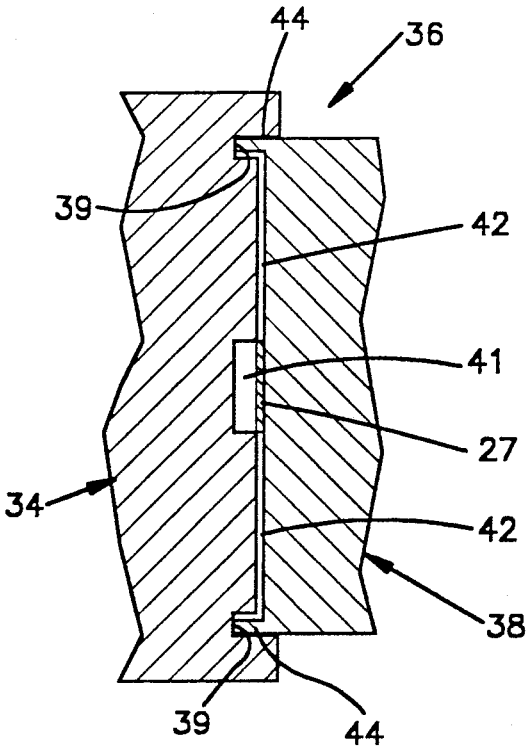
FIG. 3 is a cross section illustrating the structure for bending the free ends of the strip.

As illustrated in FIG. 3, the periphery of the forming roll 34 is provided with a pair of inwardly extending grooves 39. Extending from each of the grooves 39 to a central, shallow groove 41 are identical cylindrical wall portions 42.

The roll former 38 provides flanges 44 which project into the associated grooves 39 adjacent to the outer wall thereof and are spaced from the inner walls of the grooves 39 by a distance closely approaching the thickness of the strip of the material having the spines 28 formed thereon. At this working station, these flanges 44 bend the free ends of the spines 28 to produce a second intermediate spine shape, best illustrated in FIG. 3*a*, wherein the free ends of the spines 28 are bent at substantially right angles to form the end portion 17. The remaining portion of the spines 28, however, continues to be parallel to the base 27. The amount of twist of the spines, with respect to their length, resulting from the cutting operation can be increased or decreased by proper selection of the clearances at the forming station 36. Therefore, the twist angle can be selected to provide improved heat exchange efficiency in some applications.

Figure 4A:
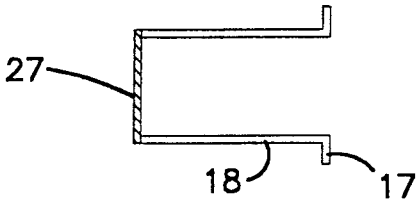
FIG. 4*a* is a cross section of the strip after it has been bent to a U-shape.
Figure 4:
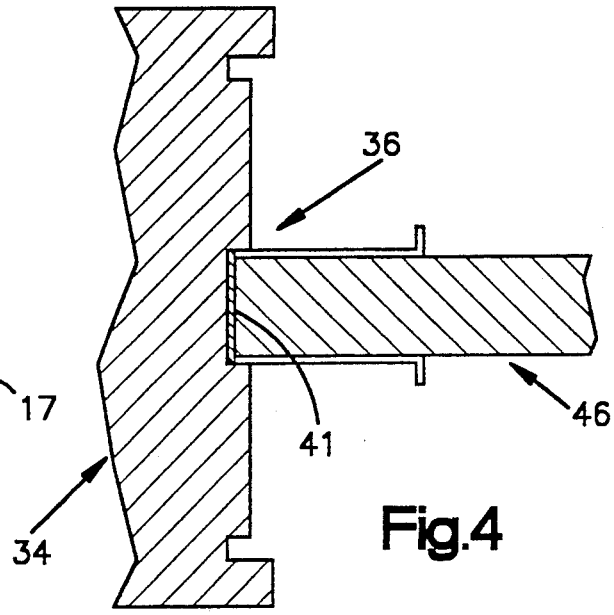
FIG. 4 is a cross section taken illustrating the structure for bending the strip to a U-shape.

After passing through the forming station 36 provided by the rolls 34 and 38, the strip of material continues along a periphery of the forming roll 34 to the forming station 37, where the strip is bent to a U-shape, as illustrated in FIGS. 4 and 4*a*. At this forming station, a relatively thin roller 46 provides a periphery which extends into the central groove 41 on the roller 34 and presses the base 27 into the central groove 41, causing the strip to assume a U-shape, best illustrated in FIG. 4*a*, in which the spine 28 extends perpendicular to the base 27 and parallel to each other. The position of the lateral end portions 17 relative to the remaining portion of the spine remains unchanged at this work station. With this structure, two forming operations are performed: first, by the form roller 34 in cooperation with the roll former 38; and, second, by cooperation of the form roller 34 and the roller 46.

Figure 5A:
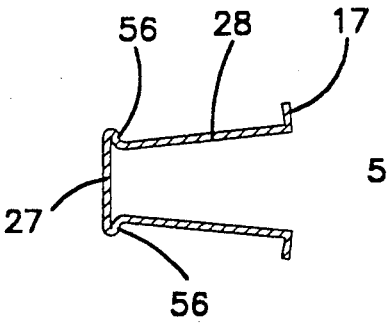
FIG. 5*a* is a cross section of the strip after the hemming operation.
Figure 5:
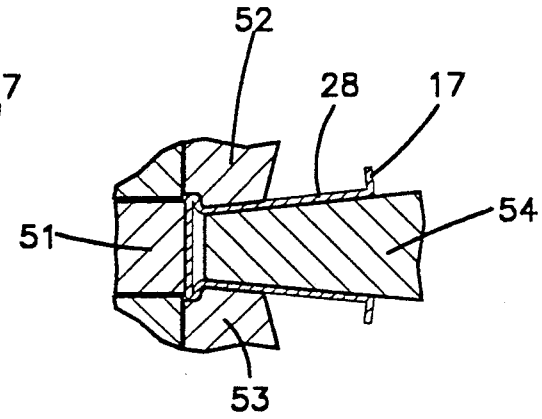
FIG. 5 is a fragmentary cross section illustrating the structure at the hemming station.

From the forming station 37, the strip of material passes to a hemming station 47, best illustrated in FIG. 5. Three rolls 51, 52, and 53 are provided at such hemming station, and all have substantially the same diameter and rotate at the same velocity, to minimize any tendency for skinning to occur when the strip is engaged. A gear drive is provided to produce such rotation, as more fully described in the '375 patent, supra. An idler roll 54 extends between the adjacent faces of the two rolls 52, 53 and is provided with a shallow, conical face adjacent to the peripheries of the two rolls 52 and 53. At this hemming station, the strip is formed to the shape illustrated in FIG. 5*a*, in which the base 27 is reversely bent to produce a hem 56 along its opposite edges and provides spines 28, which diverge at a small angle to the lateral portions 17.

The hemmed strip then passes around an inclined roll 57 to the tube 11 feeding up along the vertical axis 22, and is wrapped around such tube in a helical form. As the strip rolls around the inclined roll 57, it is inclined upwardly toward the tube 11 at an angle substantially equal to the helix angle of winding. As the strip is wound around the tube, the outer wall of the hem 56 is pulled tighter than the inner wall because of the difference in diameters, so that the fins 28 are pulled inwardly and become substantially parallel, as illustrated in FIG. 1.

The winding head 21 is identical with the winding head illustrated in the '375 patent, except for the modification of the form roller 34 to provide the grooves 39 and the addition of the roll former 38. Therefore, the manufacture of a machine winding head to produce the spines having laterally extending end portions 17 is accomplished without appreciable additional cost or complication.

Figure 6A:
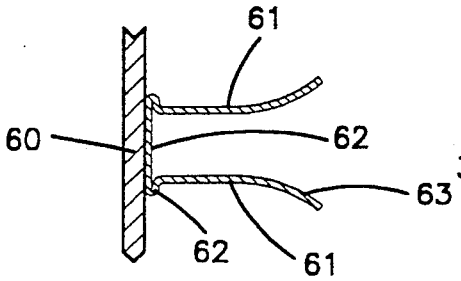
FIG. 6*a* is a fragmentary section of a heat exchanger "tube" wherein the free ends of the spine fins are formed with a curved shape.
Figure 6:
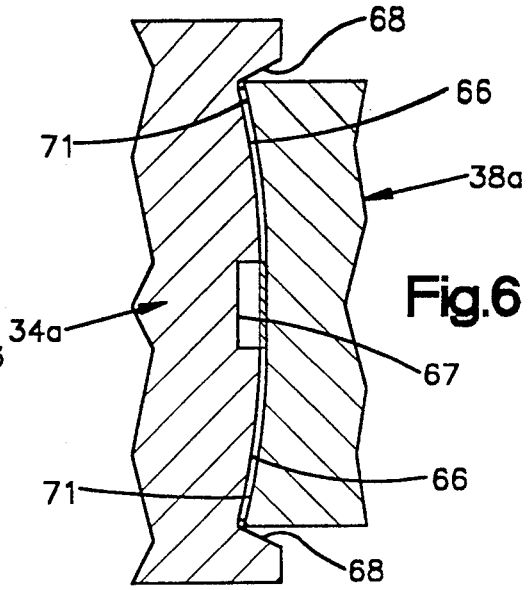
FIG. 6 is a fragmentary section of the forming station for forming the curved spine fins in accordance with a second embodiment.

Reference should now be made to FIGS. 6 and 6*a*, which respectively illustrate the apparatus for producing a second embodiment of this invention and a wound tube of such embodiment. In such embodiment, the spine fins are curved rather than provided with end portions which extend at right angles from the remaining portions of the spine. In such embodiment, the spine fin material is again helically wound on a tube 60. The spines 61 extend substantially perpendicular from a hem 62 and are then curved outwardly along their outer portions at 63. The apparatus illustrated in FIG. 6, for producing spines of such shape is provided by a forming roll 34*a* differing from the forming roll 34 of the first embodiment to provide a curved peripheral wall portion 66, while retaining the central recess 67. Adjacent to the edges of the roll, and extending from the curved wall portion 66, is a flared wall 68 which provides clearance with the spines as the spines are bent inwardly by the roll former 38*a*. In this embodiment, the roll former 38*a* is formed with a mating curvature along the portion 71 which matches the curved portion 66 to produce the curved portion 63 at the ends of the spines.

Figure 7A:
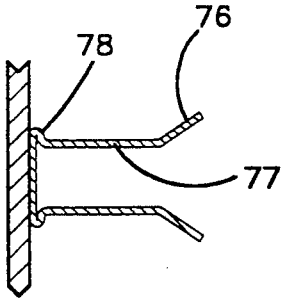
FIG. 7*a* is a fragmentary section of a heat exchanger tube in accordance with a third embodiment of this invention, in which the free ends of the spines are angulated.
Figure 7:
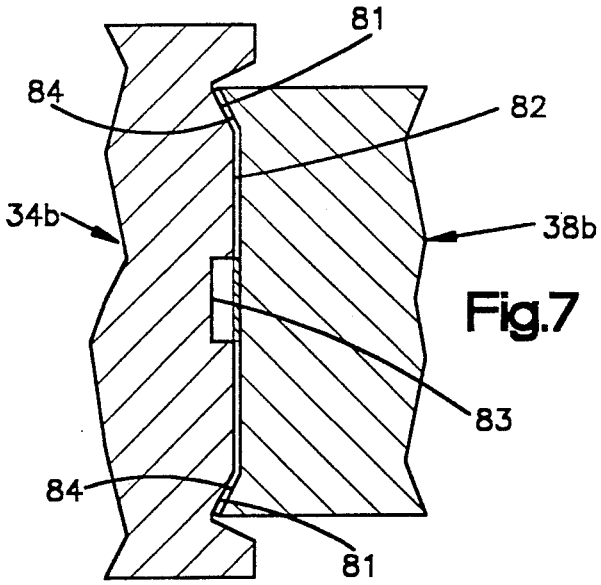
FIG. 7 is a fragmentary cross section of a forming station for forming the angulated spines in accordance with a third embodiment of this invention.

In the third embodiment of this invention illustrated in FIGS. 7 and 7*a*, the spines are provided with an outwardly extending end portion 76, which is angulated with respect to the inner spine portion 77 extending from the hem 78. Here again, the roll 34 of the first embodiment is modified as illustrated in FIG. 7. Such modified roll 34*b* differs from the roll 34 of the first embodiment in that it provides a generally V-shaped grooves 81, while retaining a cylindrical wall portion 82 extending from the grooves 81 to the central recess 83. In this instance, the modified roll 38*b* is provided with V-shaped peripheral projections 84, which mates with the grooves 81 and operates to bend the free end portion of the spine at an angle to form the angled portion 76 on the free ends of the spines.

The remaining structure and operation of the entire winding head 21 are unchanged in the second and third embodiments. Here again, the simple modification of the rolls 34 and the addition of a roll 38 permit a conventional prior art winding head to produce the spine fins of the present invention, in which the outer ends of the spines are bent in an outward direction. With this invention, the spines can be modified to optimize the performance and efficiency of a heat exchanger employing a spine fin heat exchanger tube in accordance with the present invention. Increased heat exchanger surface can be achieved in a smaller envelope, and the spine fins can be shaped to provide the best possible performance in a given installation. For example, in some installations, the flow rate over the spines may be higher and/or lower, and the spine fins can be shaped to produce the most efficient heat transfer for the particular flow conditions.

In each of the illustrated embodiments, the spine fins in one array are mirror opposites and are the same size and shape as the other array. However, in some instances, it may be desirable to provide each wrap with two arrays of spines where the spines of one array have a different size and/or shape from the spines in the other array.

In instances in which moisture tends to collect, such as in evaporators, the spine fins can be shaped to minimize the retention of such moisture on the spines. However, it is within the broader aspects of this invention to provide lateral portions at the ends of the spines which engage the ends of adjacent spines to form, in effect, a closed loop assembly.

Although the preferred embodiments of this invention have been shown and described, it should be understood that various modifications and rearrangements of the parts may be resorted to without departing from the scope of the invention as disclosed and claimed herein.

What is claimed is:

1. A spine fin heat exchanger tube comprising a tube having an outer surface, an elongated strip helically wrapped around said tube, said strip having an imperforate base portion having a predetermined width engaging said outer surface along a helical path, said helical path being formed with a helix angle resulting in a helix lead substantially larger than said predetermined width so that each portion of said base portion is spaced from the next adjacent base portion, said strip providing a multiplicity of separate spines cantileverly extending from at least one side of said base portion, said spines each providing a radial portion extending substantially radially relative to said tube and a free end portion extending laterally from said radial portion in a direction away from said one side.

2. A heat exchanger tube as set forth in claim 1, wherein each portion of said base portion is substantially spaced from the next adjacent base portion by a distance at least substantially equal to said predetermined width.

3. A heat exchanger tube as set forth in claim 2, wherein said elongated strip provides an array of a multiplicity of separate cantilever spines extending from both sides of said base portion, and each of said arrays of spines provides free end portions extending laterally in a direction away from the other array of said strip.

4. A heat exchanger tube as set forth in claim 3, wherein said spines provide inner portions extending generally radially from said base portion between said base portion and said laterally extending free end portions.

5. A heat exchanger tube as set forth in claim 4, wherein said free end portions are angled relative to said inner portions.

6. A heat exchanger tube as set forth in claim 5, wherein said free end portions extend substantially perpendicular relative to said inner portions.

7. A heat exchanger tube as set forth in claim 4, wherein said free end portions are curved laterally.

8. A heat exchanger tube as set forth in claim 4, wherein said strip provides a hem along each edge of said base portion.

9. A heat exchanger tube as set forth in claim 1, wherein said lateral free end portions are spaced from said free end portions of the adjacent wrap.

10. A heat exchanger tube as set forth in claim 9, wherein said strip provides an array of a multiplicity of separate cantilever spine fins extending from both sides of said base portion, each of said arrays of spines providing fin portions extending laterally in a direction away from the free end portions of the other array of said strip.

11. A strip of spine fin material adapted to be wrapped on a tube to form a heat exchanger tube comprising an elongated strip of material having an imperforate base portion and an array of a multiplicity of cantilever spines extending from each side of said base portion, said spines each providing an inner portion adjacent said base portion extending substantially perpendicular relative to said base portion and a free end portion extending laterally from said inner portion in the same direction.

12. A strip of spine fin material as set forth in claim 11, wherein said free end portions of each array extend laterally in a direction away from the free end portions of the other array.

13. A spine fin heat exchanger tube comprising a tube having an outer surface, an elongated strip helically wrapped around said tube, said strip having an imperforate base portion engaging said outer surface along a helical path, said strip providing an array of spines including a multiplicity of separate spines cantileverly extending from one side of said base portion, each spine in said array providing a radial inner portion extending substantially radially relative to said tube and a free end portion extending laterally from said radial portion in a direction away from said one side.

14. A heat exchanger tube as set forth in claim 13, wherein said strip provides a second array of spines extending from the other side of said base portion, each spine in said second array providing an inner radial portion extending substantially radially relative to said tube and a free end portion extending laterally from said radial portion in a direction away from the free end portions of the other array.

* * * * *